US007310571B2

(12) United States Patent
Kumazawa et al.

(10) Patent No.: US 7,310,571 B2
(45) Date of Patent: Dec. 18, 2007

(54) METHOD AND APPARATUS FOR REDUCING ENVIRONMENTAL LOAD GENERATED FROM LIVING BEHAVIORS IN EVERYDAY LIFE OF A USER

(75) Inventors: Toshimitsu Kumazawa, Yokohama (JP); Hideki Kobayashi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/684,145

(22) Filed: Mar. 9, 2007

(65) Prior Publication Data

US 2007/0225861 A1 Sep. 27, 2007

(30) Foreign Application Priority Data

Mar. 23, 2006 (JP) ..... 2006-080879

(51) Int. Cl.
*G06F 19/00* (2006.01)

(52) U.S. Cl. ..... 700/245; 700/247; 700/248; 700/251; 700/257; 700/258; 700/259; 700/260; 700/261; 700/262; 318/568.12; 318/568.13; 318/568.16; 318/568.21; 318/568.25; 901/1; 901/2; 901/27

(58) Field of Classification Search ..... 700/245, 700/247, 248, 251, 257, 258, 259, 260, 261, 700/262, 264; 318/568.11, 568.12, 568.13; 901/1, 2, 27
See application file for complete search history.

(56) References Cited

U.S. PATENT DOCUMENTS 6,493,606 B2 * 12/2002 Saijo et al. ..... 700/245
6,850,818 B2 * 2/2005 Sabe et al. ..... 700/257
7,113,848 B2 * 9/2006 Hanson ..... 700/245
7,219,064 B2 * 5/2007 Nakakita et al. ..... 704/275

(Continued)

FOREIGN PATENT DOCUMENTS

JP 2001-101292 4/2001

(Continued)

OTHER PUBLICATIONS

Logan et al., The distributed simulation of multiagent systems, 2001, IEEE, p. 174-185.*

(Continued)

*Primary Examiner*—Thomas Black
*Assistant Examiner*—McDieunel Marc
(74) *Attorney, Agent, or Firm*—Oblon, Spivak, McClelland, Maier & Neustadt, P.C.

(57) ABSTRACT

An apparatus calculates, based on unimproved behavior amounts, behavior amount variations of living behaviors when each of living behaviors increases by one unit behavior amount, calculates environmental load variation of living behavior when the living behavior increases by one unit behavior amount, by calculating sum of values each obtained by multiplying one of behavior amount variations by corresponding one of basic units, to obtain environmental load variations of living behaviors, assigns messages to living behaviors based on environment load variations of living behaviors, calculates environmental load reduction of living behavior by (a) calculating variation between one of unimproved behavior amounts and one of improved behavior amounts of living behavior, and (b) multiplying variation by environmental load variation of living behavior, to obtain environmental load reductions of living behaviors, and selects one of messages which is assigned to one of living behaviors has the largest environmental load reduction.

8 Claims, 10 Drawing Sheets

U.S. PATENT DOCUMENTS

2006/0064202 A1* 3/2006 Gutmann et al. ..... 700/245

FOREIGN PATENT DOCUMENTS

| | | |
|---|---|---|
| JP | 2001-344412 | 12/2001 |
| JP | 2003-83596 | 3/2003 |
| JP | 2003-85356 | 3/2003 |
| JP | 2004-86864 | 3/2004 |

OTHER PUBLICATIONS

Kyoko Ito, et al., "Design and Development of an Affective Interface for Supporting Energy-saving Activities and its Evaluation", IEEJ Trans. EIS, vol. 125, No. 10, 2005, pp. 1552-1564.

Katsunori Matsuoka, et al., "Development of Housing Technology for Monitoring Residents—To Protect Your Safety, Security and Health", http://www.nedo.go.jp/, Focus NEDO, vol. 3, No. 12, Dec. 2003, 4 pages.

* cited by examiner

9

| | Sleep & rest | Bath & wash | Select clothes & dress | Cook & eat | Clean & do laundry | Watch TV & listen to radio | Read | Others |
|---|---|---|---|---|---|---|---|---|
| CO2 emission (g) | 0.00 | 266.25 | 91.40 | 3992.02 | 611.82 | 274.20 | 0.00 | 264.44 |

Second basic unit storage unit

FIG. 3

| | Sleep & rest | Bath & wash | Select clothes & dress | Cook & eat | Clean & do laundry | Watch TV & listen to radio | Read | Others |
|---|---|---|---|---|---|---|---|---|
| Water (m3) | 0.000 | 0.202 | 0.000 | 0.104 | 0.036 | 0.000 | 0.000 | 0.083 |
| Electricity (kwh) | 0.000 | 0.900 | 0.200 | 1.714 | 1.333 | 0.600 | 0.000 | 0.566 |
| Gas (m3) | 0.000 | 1.000 | 0.000 | 1.429 | 0.000 | 0.000 | 0.000 | 0.000 |

FIG. 4

8

| Evaluation item | Water | Electric power | Gas |
|---|---|---|---|
| Unit | m3 | kw | m3 |
| CO2 emission basic unit (g) | 69 | 457 | 2241 |

First basic unit storage unit

FIG. 5

10

| | Sleep & rest | Bath & wash | Select clothes & dress | Cook & eat | Clean & do laundry | Watch TV & listen to radio | Read | Others | Go out | Total |
|---|---|---|---|---|---|---|---|---|---|---|
| 1st day | 7.55 | 0.51 | 0.53 | 0.73 | 1.55 | 2.52 | 0.69 | 1.06 | 8.86 | 24.00 |
| 2nd day | 7.37 | 0.50 | 0.55 | 0.73 | 1.01 | 2.03 | 0.66 | 1.10 | 10.05 | 24.00 |
| 3rd day | 7.44 | 0.52 | 0.53 | 0.75 | 1.54 | 2.67 | 0.71 | 1.02 | 8.82 | 24.00 |
| 4th day | 7.61 | 0.49 | 0.51 | 0.70 | 1.17 | 3.12 | 0.61 | 1.11 | 8.68 | 24.00 |
| 5th day | 7.58 | 0.51 | 0.52 | 0.77 | 1.62 | 2.44 | 0.68 | 1.09 | 8.79 | 24.00 |
| 6th day | 7.73 | 0.50 | 0.51 | 0.71 | 1.09 | 2.75 | 0.72 | 1.98 | 9.01 | 24.00 |
| 7th day | 7.32 | 0.51 | 0.54 | 0.72 | 1.52 | 2.37 | 0.69 | 1.04 | 9.29 | 24.00 |
| Average | 7.51 | 0.51 | 0.53 | 0.73 | 1.36 | 2.56 | 0.68 | 1.06 | 9.07 | 24.00 |

Behavior amount storage unit

FIG. 6

| | Sleep & rest | Bath & wash | Select clothes & dress | Cook & eat | Clean & do laundry | Watch TV & listen to radio | Read | Others |
|---|---|---|---|---|---|---|---|---|
| Sleep & rest | 1 | -0.398 | -0.903 | -0.199 | -0.21 | 0.6454 | 0.0316 | -0.23 |
| Bath & wash | -0.398 | 1 | 0.3588 | 0.7174 | 0.7816 | -0.341 | 0.7016 | -0.393 |
| Select clothes & dress | -0.903 | 0.3588 | 1 | 0.234 | 0.0497 | -0.863 | 0.0915 | 0.1991 |
| Cook & eat | -0.199 | 0.7174 | 0.234 | 1 | 0.6428 | -0.438 | 0.3451 | 0.1039 |
| Clean & do laundry | -0.21 | 0.7816 | 0.0497 | 0.6428 | 1 | -0.041 | 0.3281 | -0.063 |
| Watch TV & listen to radio | 0.6454 | -0.341 | -0.863 | -0.438 | -0.041 | 1 | -0.268 | -0.131 |
| Read | 0.0316 | 0.7016 | 0.0915 | 0.3451 | 0.3281 | -0.268 | 1 | -0.861 |
| Others | -0.23 | -0.393 | 0.1991 | 0.1039 | 0.063 | -0.131 | -0.861 | 1 |

FIG. 7

11

| | Sleep & rest | Bath & wash | Select clothes & dress | Cook & eat | Clean & do laundry | Watch TV & listen to radio | Read | Others |
|---|---|---|---|---|---|---|---|---|
| CO2 emission (g) | -1949.4 | 5843.9 | 1828.6 | 6226.8 | 5238.1 | -2522.4 | 3156.1 | -425.4 |
| Improving direction | + | - | - | - | - | + | - | + |

First variation storage unit

FIG. 8

12

| | Information contents | Information presentation method |
|---|---|---|
| Sleep & rest | "Sleep for eight hours a night for your health and looks" | Display on information terminal |
| Bath & wash | "Water consumption too much" | Warning message by voice |
| Select clothes & dress | "Today's lucky color is ○" | Display on information terminal |
| Cook & eat | "Water dripping: Turn faucet off fully every time" | Warning message by voice |
| Clean & do laundry | "This room is clean enough" | Display on information terminal |
| Watch TV & listen to radio | "Much-talked-about program ○○ now on air!" | Display on information terminal |
| Read | "Rest your brain by limiting reading time to an hour a day" | Display on information terminal |
| Others | Nothing | Nothing |

Presentation information storage unit

FIG. 9

8

| | Sleep & rest |
|---|---|
| 1st day | 7.85 |
| 2nd day | 7.69 |
| 3rd day | 7.71 |
| 4th day | 7.91 |
| 5th day | 7.91 |
| 6th day | 8.03 |
| 7th day | 7.60 |
| Average | 7.81 |

Behavior amount storage unit

FIG. 10

13

| | Sleep & rest | Bath & wash | Select clothes & dress | Cook & eat | Clean & do laundry | Watch TV & listen to radio | Read | Others |
|---|---|---|---|---|---|---|---|---|
| Time-change (h) | 0.3 | -0.7 | -0.1 | -0.2 | -0.2 | 0.4 | -0.1 | 0.8 |

Second variation storage unit

FIG. 11

METHOD AND APPARATUS FOR REDUCING ENVIRONMENTAL LOAD GENERATED FROM LIVING BEHAVIORS IN EVERYDAY LIFE OF A USER

CROSS-REFERENCE TO RELATED APPLICATIONS

This application is based upon and claims the benefit of priority from prior Japanese Patent Application No. 2006-080879, filed Mar. 23, 2006, the entire contents of which are incorporated herein by reference.

BACKGROUND OF THE INVENTION

1. Field of the Invention

The present invention relates to a method and apparatus for supporting living behavior to reduce environmental load, which promote reduction of an environmental load generated by living behaviors.

2. Description of the Related Art

Surveys conducted by National consumer affairs center of Japan have revealed that more than 90% of the people of Japan are interested in energy savings. However, energy consumption by the public is continuously growing yet to produce a gap between public awareness and behavior for the environment.

Energy savings in households can be achieved by improving the performance of energy using products and houses and controlling energy consumption. Energy consumption control is roughly classified into two schemes: automatic control by hardware and indirect control by presenting information.

In automatic control by hardware, energy using products are adjusted on the basis of information of sensors (e.g., a temperature sensor and a pyroelectric sensor) to minimize the waste in the operations of the products, thereby saving the energy (e.g., JP-A 2003-083596 (KOKAI), and JP-A 2003-085356 (KOKAI).

In indirect control by presenting information, the target values and actual values of energy consumption are displayed in the form of ranking or comparison with others to arouse consumers' awareness and behavior for energy savings (e.g., JP-A 2001-101292 (KOKAI), and JP-A 2001-344412 (KOKAI).

Most conventional indirect control methods by presenting information pay attention to only an environmental load reduction effect related to a given isolated behavior. Even with attention to the load in a whole household, the correlation between behaviors is not taken into consideration. It is consequently impossible to efficiently reduce the environmental load generated by living behaviors in a household.

The present invention has been made in consideration of the above-described problem, and has as its object to provide a method and apparatus for supporting living behavior to reduce environmental load, which allow to efficiently reduce the environmental load generated by living behaviors in a household.

BRIEF SUMMARY OF THE INVENTION

According to embodiments of the present invention, an apparatus, which supports living behavior to reduce environmental load, (a) calculates, based on an unimproved behavior amount of each of a plurality of different kinds of living behaviors in everyday life of a user, behavior amount variations of the living behaviors when each living behavior increases by one unit behavior amount; (b) calculates an environmental load variation of each living behavior when the each living behavior increases by one unit behavior amount, by calculating a sum of values each obtained by multiplying each of the behavior amount variations by a basic unit of each of the living behaviors, the basic unit being an environmental load generated per unit behavior amount of the each of the living behaviors; (c) assigns messages to the living behaviors based on the environment load variation of the each living behavior, by assigning, to the each living behavior which increases the environmental load, a message being for reducing the behavior amount of the each living behavior, and assigning, to the each living behavior which decreases the environmental load, a message being for increasing the behavior amount of the each living behavior; (d) calculates an environmental load reduction of the each living behavior by calculating a variation between the unimproved behavior amount of the each living behavior and an improved behavior amount of the each living behavior which is measured when the message assigned to the each living behavior is presented to the user and multiplying the variance by the environmental load variation of the each living behavior; and (e) selects one of the messages which is assigned to one of the living behaviors has the largest environmental load reduction.

BRIEF DESCRIPTION OF THE SEVERAL VIEWS OF THE DRAWING

FIG. 3 is a view showing an example of basic unit data by behavior stored in a second basic unit storage unit;

FIG. 4 is a table showing an example of data representing the consumptions of water, electricity, and gas per unit behavior amount which are measured for each living behavior;

FIG. 5 is a view showing an example of environment load basic unit data stored in a first basic unit storage unit;

FIG. 6 is a view showing an example of unimproved behavior amount data stored in a behavior amount storage unit;

FIG. 7 is a table showing an example of data representing behavior amount correlation between living behaviors calculated by a second calculation unit;

FIG. 8 is a view showing an example of environment load variation data calculated by the second calculation unit and stored in a first variation storage unit;

FIG. 9 is a view showing an example of presentation information stored in a presentation information storage unit;

FIG. 10 is a view showing an example of improved behavior amount data stored in the behavior amount storage unit;

FIG. 11 is a view showing an example of behavior amount variation data calculated by a third calculation unit and stored in a second variation storage unit.

DETAILED DESCRIPTION OF THE INVENTION

An embodiment of the present invention will be described below with reference to the accompanying drawing.

Figure 1:
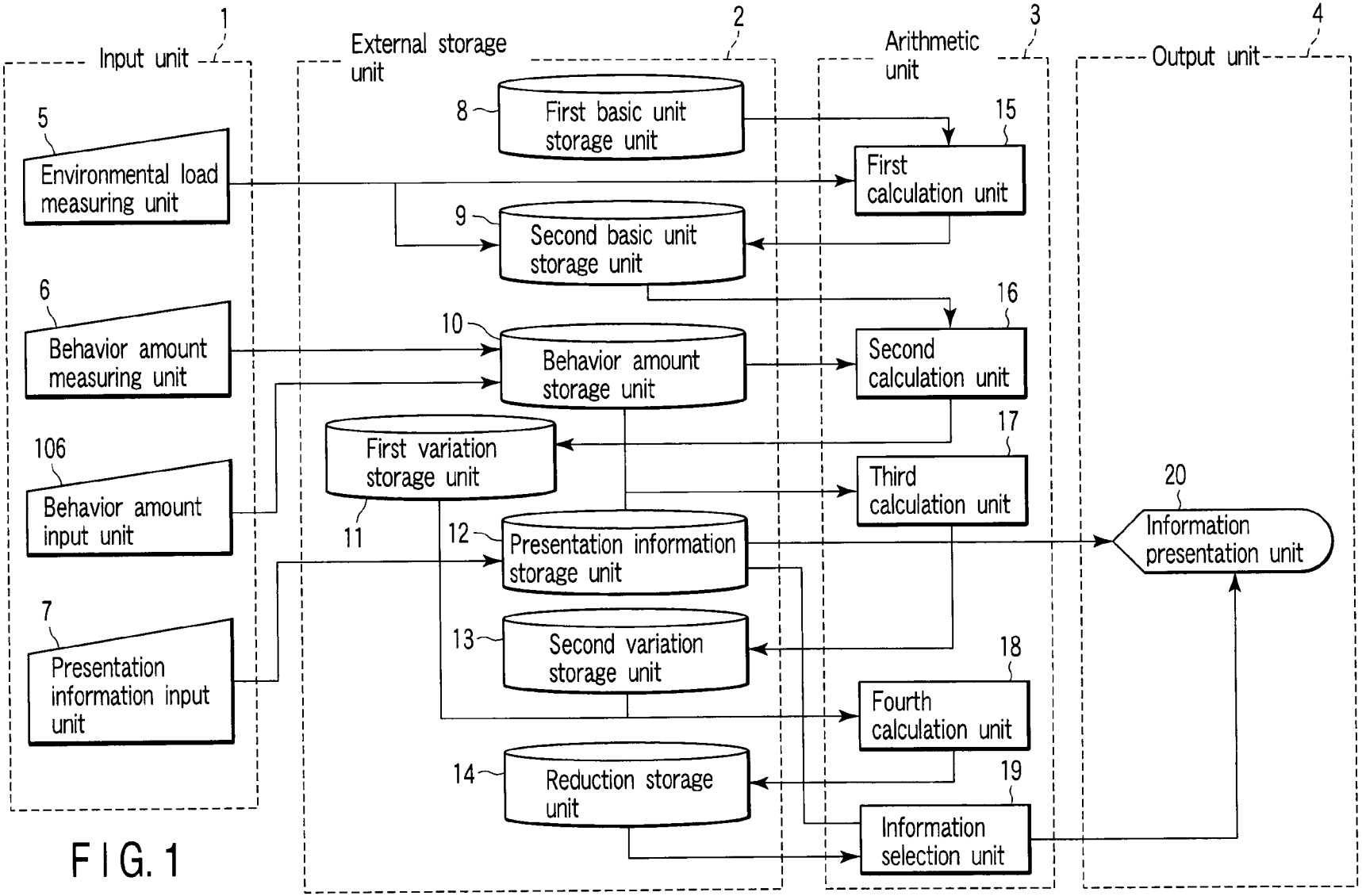
FIG. 1 is a block diagram showing an arrangement example of a system for supporting living behavior to reduce environmental load according to an embodiment.

FIG. 1 is a block diagram showing an arrangement example of a system for supporting living behavior to reduce environmental load according to this embodiment, which reduces the environmental load generated by user's living behaviors. As shown in FIG. 1, the system for supporting living behavior to reduce environmental load includes an input unit 1, external storage unit 2, arithmetic unit 3, and output unit 4.

The input unit 1 includes an environmental load measuring unit 5, behavior amount measuring unit 6, presentation information input unit 7, and behavior amount input unit 106.

The external storage unit 2 includes a first basic unit storage unit 8, second basic unit storage unit 9, behavior amount storage unit 10, first variation storage unit 11, presentation information storage unit 12, second variation storage unit 13, and reduction storage unit 14.

The arithmetic unit 3 includes a first calculation unit 15, a second calculation unit 16, a third calculation unit 17, a fourth calculation unit 18, and a information selection unit 19.

The output unit 4 includes an information presentation unit 20.

Figure 2:
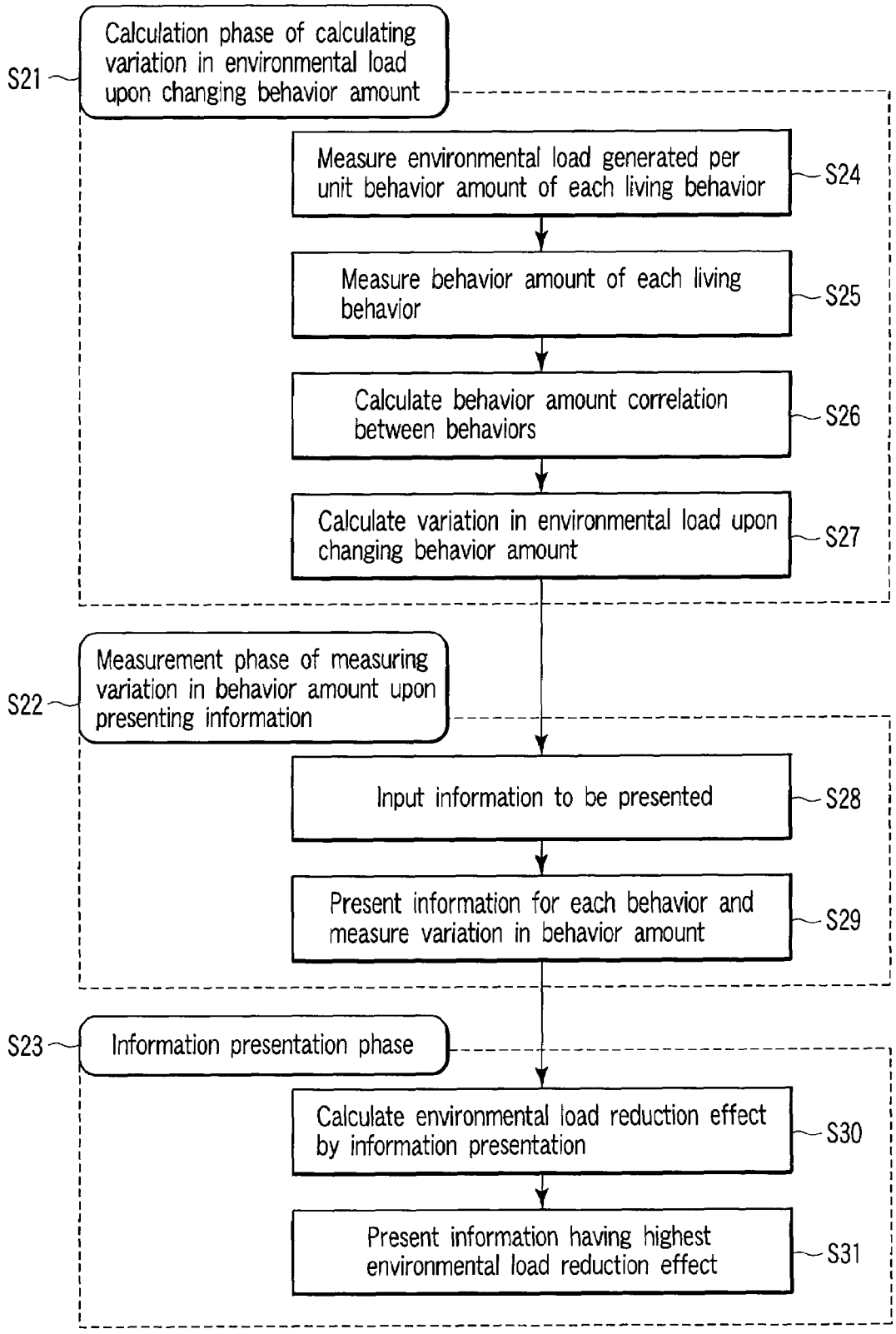
FIG. 2 is a flowchart for explaining the processing operation of the system for supporting living behavior to reduce environmental load.

FIG. 2 is a flowchart for explaining the processing operation of the system for supporting living behavior to reduce environmental load shown in FIG. 1. FIG. 2 shows the procedures of a method of supporting living behavior to reduce environmental load, which reduces the environmental load generated by user's living behaviors.

The method of supporting living behavior to reduce environmental load, which reduces an environmental load generated by a plurality of different kinds of living behaviors of a predetermined user in a day of daily life, will be described.

The procedures include a calculation phase S21 of calculating a environmental load variation of each living behavior upon changing a behavior amount of the each living behavior, a measurement phase S22 of measuring a variation in behavior amount upon presenting information, and an information presentation phase S23. A detailed example will be described below with reference to FIG. 2.

First, in step S24, the environmental load measuring unit 5 measures the environmental load per unit behavior amount of each of a plurality of different kinds of living behaviors of a user at home in a day of daily life. The second basic unit storage unit 9 of the external storage unit 2 stores basic unit data per behavior shown in FIG. 3.

The living behaviors in a household are classified into "sleep & rest", "bath & wash", "select clothes & dress", "cook & eat", "clean & do laundry", "watch TV & listen to radio", "read", and "others". These are the living behaviors of the user. The living behaviors at home may finely be classified in more detail. Alternatively, a focus may be placed on only a few living behaviors.

A behavior amount indicates the amount of a living behavior at home. In this embodiment, a behavior amount of a living behavior corresponds to the time when the user is engaged in the living behavior. That is, an environmental load per unit behavior amount of a living behavior indicates an environmental load when the user has engaged in the living behavior for 1 hour. The behavior amount may be represented by a count in place of the time duration.

An environmental load indicates a human's behavior-based factor that provokes troubles in preserving the global environment, including water consumption, electricity consumption, gas consumption, and CO2 emission.

In this embodiment, the environmental load is the CO2 emission that is difficult to directly measure. The environmental load measuring unit 5 having a flowmeter and a wattmeter measures the water, electricity, and gas consumption of each living behavior to obtain water, electricity, and gas consumption data of each living behavior, as shown in FIG. 4.

The first calculation unit 15 calculates the sum of products of basic unit data, i.e., the CO2 emission per unit amount of water, electricity, and gas shown in FIG. 5 and the water, electricity, and gas consumption data per unit behavior amount shown in FIG. 4, thereby calculating the environmental load per unit behavior amount shown in FIG. 3.

For, e.g., living behavior "select clothes & dress, the water, electricity, and gas consumption per unit behavior amount is "0.000" $m^3$, "0.200" kwh, and "0.000" $m^3$, respectively, as can be seen from FIG. 4. The sum of products of these consumptions and the CO2 emission s per unit amount of water, electricity, and gas, i.e., "69" g, "457" g, and "2241" g shown in FIG. 5 are "69" g×"0.000" $m^3$+"457" g×"0.200" kwh+"2241" g×"0.000" $m^3$="91.4" g.

The first calculation unit 15 stores the environmental load per unit behavior amount shown in FIG. 3, which are obtained in the above-described way, in the second basic unit storage unit 9.

The basic unit data shown in FIG. 5 is obtained from the database of an existing Life Cycle Assessment in advance.

In this example, the environmental load measuring unit 5 measures the water, electricity, and gas consumption per unit behavior amount of each living behavior shown in FIG. 4. Instead, data that are measured separately or prepared in advance may be input to the first calculation unit 15.

In step S25, the behavior amount measuring unit 6 measures the behavior amount of each living behavior in a day as shown in FIG. 6 for a predetermined period (e.g., one week) and stores the behavior amount data in the behavior amount storage unit 10.

The behavior amount data is obtained by measuring the behavior amount (time) of each living behavior every day by the behavior amount measuring unit 6.

In this embodiment, the behavior amount measuring unit 6 detects user's passage by using, e.g., a pyroelectric sensor and measures the time when the user is at a specific place. Pyroelectric sensors are provided on, e.g., a bathroom door, bed, and kitchen door. The behavior amount measuring unit 6 measures the interval between the first detection time and the next detection time by the pyroelectric sensor. As a result, the pyroelectric sensor provided on the bathroom door measures the behavior amount of living behavior "bath & wash". The pyroelectric sensor provided on the bed measures the behavior amount of living behavior "sleep & rest". The pyroelectric sensor provided on the kitchen door measures the behavior amount of living behavior "cook & eat".

The behavior amount measuring unit 6 may always measure the traffic lines and postures/active masses/pulse rates of humans, the open/closed states of windows and doors, and the use situations of household electrical appliances by using a number of kinds of sensors arranged in home, collect sensor information containing the magnitudes and durations of actions through a home network, estimate living behaviors, and measure the duration of each living behavior, as described in, e.g. reference (Katsunori Matsuoka & Akira Fujishima, "Development of Housing Technology for Monitoring Residents—To Protect Your Safety, Security and Health", Focus NEDO, Vol. 3, No. 12, pp. 11-12, 2003. 12).

In this example, the behavior amount of each living behavior measured by the behavior amount measuring unit 6 is stored as behavior amount data. Instead, behavior amount data shown in FIG. 6 which are measured separately or prepared in advance may be input from the behavior amount input unit 106 and stored in the behavior amount storage unit 10.

In step S26, the second calculation unit 16 calculates the single correlation coefficient of behavior amount between the living behaviors by using the behavior amount data stored in the behavior amount storing unit 10 to obtain behavior amount correlation data between the living behaviors, as shown in FIG. 7. A single correlation coefficient $r_{jk}$ between a living behavior j and a living behavior k is given by $$r_{jk} = \frac{\sum_i (x_{ij} - \overline{x_j})(x_{ik} - \overline{x_k})}{\sqrt{\sum_i (x_{ij} - \overline{x_j})^2 \times \sum_i (x_{ik} - \overline{x_k})^2}} \quad (1)$$

Where, $x_{ij}$ is a behavior amount of a living behavior j in i-th day, $\overline{x}_j$ is a average of behavior amount of the living behavior j, $x_{ik}$ is a behavior amount of a living behavior k in i-th day, $\overline{x}_k$ is a average of behavior amount of the living behavior k.

The second calculation unit 16 stores the obtained behavior amount correlation data shown in FIG. 7 in the first variation storage unit 11.

In the behavior amount correlation data table shown in FIG. 7, each row (horizontal line) corresponds to one living behavior (living behavior j). A variation (single correlation coefficient $r_{jk}$) in the behavior amount of another living behavior (living behavior k in a column) when the behavior amount of the aforesaid living behavior increases by one unit behavior amount is shown in the cell at the intersection between the row and the column of the other living behavior.

When, e.g., living behavior "sleep & rest" of the first row in FIG. 7 increases by one unit behavior amount (e.g., 1 hour), living behavior "bath & wash" decreases by "0.398" hours, and living behavior "watch TV & listen to radio" increases by "0.6454" hours.

In step S27, the second calculation unit 16 calculates, for each living behavior, the sum of products of the basic unit data per behavior shown in FIG. 3 and the behavior amount correlation data between the living behaviors shown in FIG. 7 calculated in step S26 to obtain environment load variation data shown in FIG. 8. The first variation storage unit 11 stores the environment load variation data.

For, e.g., living behavior "sleep & rest", the second calculation unit 16 calculates the sum of products of the basic unit data per behavior shown in FIG. 3 and the data of the row of "sleep & rest" of the behavior amount correlation data between the behaviors in FIG. 7, as shown in equation (2) below (the products of the basic unit data in FIG. 3 corresponding to the living behaviors and the correlation data in FIG. 7 are added for all living behaviors). The resultant calculated value "−1949.3" is stored in the first variation storage unit 11. The calculated value is a negative value. This indicates that the environmental load decreases when the behavior amount of living behavior "sleep & rest" increases. The improving direction of the behavior amount of "sleep & rest" is defined as "+" and stored in the first variation storage unit 11.

$$\begin{aligned} &0.00\times1+2666.25\times(-0.398)+91.40\times(-0.903) \\ &+3992.02\times(-0.199)+611.82\times(-0.21) \\ &+274.20\times0.6454+0.00\times0.0316+264.44\times(-0.23) \\ &=-1949.3 \end{aligned} \quad (2)$$

The environment load variation data shown in FIG. 8 represents environmental load variation when the behavior amount of each living behavior increases by one unit amount. When the behavior amount of a living behavior with a negative variation in environmental load increases, the environmental load generated by a plurality of living behaviors of the user in a day of daily life decreases (improves). Conversely, when the behavior amount of a living behavior with a positive variation in environmental load decreases, the environmental load generated by a plurality of living behaviors of the user in a day of daily life decreases (improves).

In step S28, the presentation information input unit 7 inputs the presentation information (message) to improve the environmental load generated by each living behavior and a presentation method. The presentation information and presentation method input for each living behavior are stored in the presentation information storage unit 12, as shown in FIG. 9, in correspondence with the living behavior.

The presentation information input unit 7 may be an input unit such as a personal computer or a device which acquires data from a server through a communication network.

For example, the presentation information input unit 7 acquires, from a server through a communication network, the presentation information (message) to improve the environmental load generated by each living behavior and a presentation method and stores them in the presentation information storage unit 12 as shown in FIG. 9.

The presentation information to improve the environmental load generated by each living behavior may be stored in the presentation information storage unit 12 in advance. In this case, the presentation information storage unit 12 stores in advance, e.g., presentation information that should be presented to increase the behavior amount when the sign of the variation in environmental load is negative and a method of presenting the information, and presentation information that should be presented to decrease the behavior amount when the sign of the variation in environmental load is positive and a method of presenting the information. Presentation information corresponding to the sign of environment load variation data of each living behavior in FIG. 8 is selected from the presentation information of the living behaviors stored in the presentation information storage unit 12. This selection may be done by, e.g., the information selection unit 19. Alternatively, another presentation information selection unit may newly be added.

For, e.g., living behavior "sleep & rest" of the environment load variation data shown in FIG. 8, the environment load variation in living behavior has a negative sign. This indicates that the environmental load amount decreases when the behavior amount of this living behavior increases. Hence, presentation information "Sleep for eight hours a day for your health and beauty!", as shown in FIG. 9, is input or selected and assigned to living behavior "sleep & rest" to promote the user to increase the behavior amount of "sleep & rest".

In this way, in step S28, presentation information (message) to improve the environmental load is assigned to each living behavior depending on whether the environmental load increases or decreases when the living behavior increases by one unit behavior amount. The message assigned to each living behavior is stored in correspondence with the living behavior, as shown in FIG. 9.

In step S29, the information presentation unit 20 presents the presentation information assigned to each living behavior.

In this example, presentation information assigned to each of the seven living behaviors is presented, as shown in FIG. 9.

First, one of the seven living behaviors is set as the improvement target. When presentation information assigned to the living behavior of the improvement target is presented, the behavior amount measuring unit 6 measures the daily behavior amount of the living behavior of the user for a predetermined period (e.g., one week). The behavior amount storage unit 10 stores the measured daily behavior amount of the living behavior as the improved behavior amount data of the living behavior when the presentation information is presented, as shown in FIG. 10.

The behavior amount data corresponding to each living behavior measured in step S29 will be referred to as improved behavior amount data. The behavior amount data corresponding to the living behavior measured in step S25 will be referred to as unimproved behavior amount data.

FIG. 10 shows improved behavior amount data when living behavior "sleep & rest" is set as an improvement target, and presentation information (FIG. 9) assigned to the living behavior is presented.

Next, another of the seven living behaviors is set as the improvement target. When presentation information assigned to the living behavior of the improvement target is presented, the behavior amount measuring unit 6 measures the daily behavior amount of the living behavior of the user for a predetermined period (e.g., one week) in the same way as described above. The behavior amount storage unit 10 stores the measured daily behavior amount of the living behavior as the improved behavior amount data of the living behavior when the presentation information is presented.

For each of the seven living behaviors, presentation information assigned to the living behavior is presented, and the daily behavior amount of the living behavior of the user is measured for a predetermined period (e.g., one week). Finally (e.g., after seven weeks), the behavior amount storage unit 10 stores seven improved behavior amount data having the same format as in FIG. 10 in correspondence with the seven living behaviors.

In this example, the behavior amount of each living behavior measured and input by the behavior amount measuring unit 6 is stored as improved behavior amount data. Instead, improved behavior amount data of each living behavior which is measured separately may be input from the behavior amount input unit 106 and stored in the behavior amount storage unit 10.

The third calculation unit 17 calculates the average value of the daily behavior amounts in each of the plurality of (e.g., seven) improved behavior amount data corresponding to the living behaviors. The third calculation unit 17 then calculates the difference between this average value and that of the behavior amounts of the living behavior in the unimproved behavior amount data shown in FIG. 6. As a result, the behavior amount variation data of each living behavior is obtained, which represents the variation between the behavior amount (unimproved behavior amount data) before the presentation information assigned to the living behavior is presented and the behavior amount (improved behavior amount data) after the presentation information is presented, as shown in FIG. 11. The second variation storage unit 13 stores the behavior amount variation data shown in FIG. 11.

For, e.g., living behavior "sleep & rest", the presentation information "Sleep for eight hours a night for your health and looks!" assigned in step S28 is displayed on an information terminal (corresponding to the information presentation unit 20) held by the user (e.g., at a predetermined time, always, or at a predetermined timing). The behavior amount measuring unit 6 measures the time (behavior amount) of the user's sleep & rest during the measurement time (one week). The measured daily behavior amount is input and stored in the behavior amount storage unit 10.

Referring to FIG. 10, the average value of the behavior amounts of living behavior "sleep & rest" is "7.81". The average value of the behavior amounts of living behavior "sleep & rest" in the unimproved behavior amount data in FIG. 6 is "7.51". The difference between them is "0.3". This is the behavior amount variation value of "sleep & rest" on the first column of the behavior amount variation data corresponding to living behavior "sleep & rest" in FIG. 11.

The information presentation unit 20 includes, e.g., an image display device such as a display and a voice output device. The timing when the information presentation unit 20 presents presentation information (message) assigned to a living behavior set as an improvement target in measuring the improved behavior amount data of the living behavior is not particularly limited. The presentation information can be presented, e.g., at a preset time or when the user executes a predetermined operation or manipulation.

In this embodiment, the behavior amount is measured as time duration. The behavior amount variation therefore corresponds to the length of time required for the behavior that has changed upon information presentation.

Figure 12:
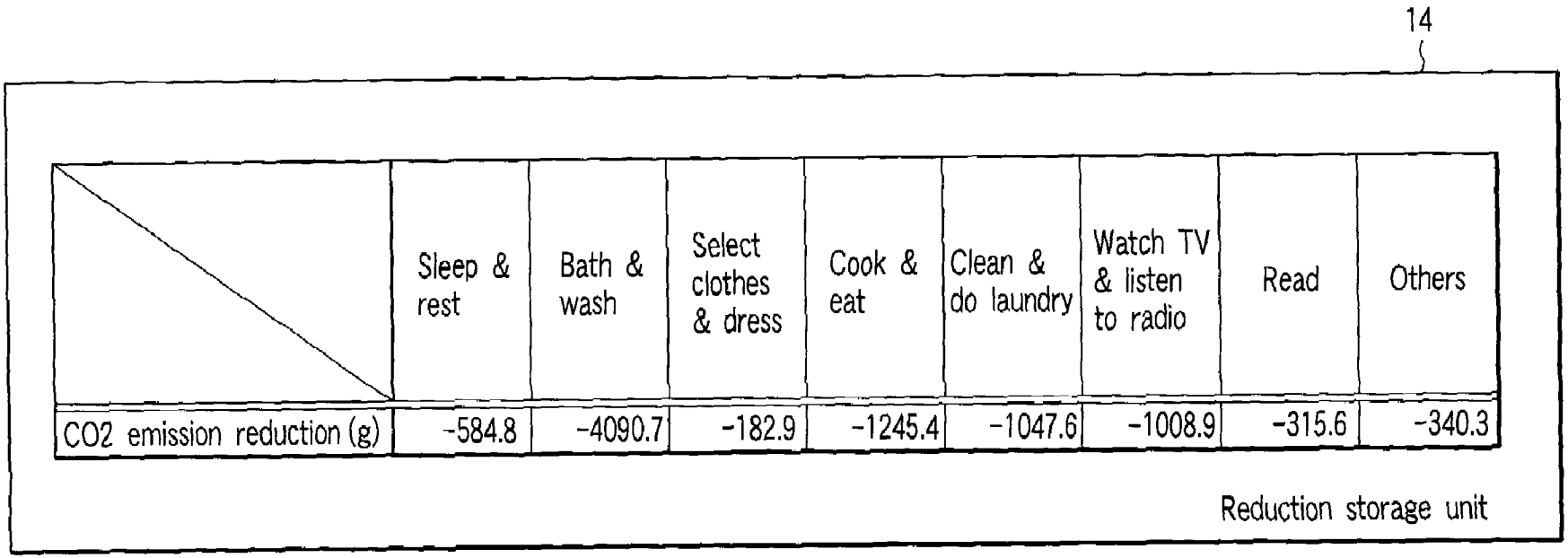
FIG. 12 is a view showing an example of reduction data calculated by a fourth calculation unit and stored in a reduction storage unit.

In step S30, the fourth calculation unit 18 calculates the product of the variation and behavior amount variation of each living behavior by using the variation data in FIG. 8 and the behavior amount variation data in FIG. 11 to obtain environment load reduction data representing the environment load reduction of each living behavior, as shown in FIG. 12. The reduction storage unit 14 stores the environment load reduction data shown in FIG. 12.

As described above, the environment load variation data shown in FIG. 8 represents the environmental load variation when the behavior amount of each living behavior increases by one unit amount (e.g., 1 hour). Hence, for example, when the behavior amount variation (the unit is in time duration) of each living behavior in the behavior amount variation data shown in FIG. 11 is multiplied by the environment load variation of the living behavior in FIG. 8, the reduction of the environmental load of each living behavior as shown in FIG. 12 is obtained.

The environment load reduction data in FIG. 12 represents the amount of environmental load in each living behavior, which is reduced by information presentation.

In step S31, the information selection unit 19 selects, from presentation information assigned to each living behavior, presentation information having a highest environmental load reduction effect on the basis of the environment load reduction data in FIG. 12 stored in the reduction storage unit 14.

More specifically, the information selection unit 19 selects a living behavior with a largest environmental load reduction from the environment load reduction data shown in FIG. 12. The presentation information assigned to the selected living behavior in step S28 is selected as presentation information having the highest environmental load reduction effect.

In the environment load reduction data in FIG. 12, "bath & wash" is the living behavior with a largest environmental load reduction. Hence, a message (presentation information) "Water consumption too much" assigned to the living behavior is selected as presentation information having a highest environmental load reduction effect the user.

After that, the information presentation unit 20 presents the selected presentation information, e.g., at a preset time or when the user executes a predetermined operation or manipulation. The processing from step S24 in FIG. 2 may be executed again to, e.g., measure the behavior amount when the selected presentation information is being presented. Alternatively, presentation information having a highest environmental load reduction effect may be selected when the selected presentation information is being presented.

In step S31, the information selection unit 19 may further select a message (presentation information) assigned to the living behavior with a second largest environmental load reduction in step S28 on the basis of the environment load reduction data stored in the reduction storage unit 14.

The information presentation unit 20 may present the presentation information having a second highest environmental load reduction effect together with the precedingly selected presentation information having a highest environmental load reduction effect.

If environmental load reduction represented by the environment load reduction information shown in FIG. 12 is achieved by presenting, by the information presentation unit 20, presentation information selected as presentation information data having a highest environmental load reduction effect, the processing from step S24 in FIG. 2 may be executed again to select presentation information having the highest environmental load reduction effect again.

The CO2 emission has been exemplified above as the environmental load. Even when the water, electricity, or gas consumption is defined as the environmental load, it is possible to select presentation information having a highest consumption reduction effect in accordance with the same procedures as in FIG. 2. The water, electricity, or gas consumption can be directly measured, unlike the CO2 emission. Hence, the water, electricity, or gas consumption per unit behavior amount of each living behavior shown in FIG. 4 is directly used as environment load basic unit data. Hence, when the water, electricity, or gas consumption per unit behavior amount of each living behavior shown in FIG. 4 replaces the basic unit data in the above description in which the CO2 emission is defined as the environmental load, the above description of the embodiment is applicable as the description of procedures of the method of supporting living behavior to reduce environmental load when the water, electricity, or gas consumption is defined as the environmental load.

As described above, according to this embodiment, in the calculation phase S21 of calculating a environmental load variation upon changing a behavior amount, environment load basic unit per a living behavior (FIG. 3 or 4) representing the environmental load per unit behavior amount of each living behavior is stored. Unimproved behavior amount data (FIG. 6) representing a behavior amount corresponding to each of a plurality of different kinds of living behaviors of a user in a day of daily life is stored. On the basis of the unimproved behavior amount data, the behavior amount variations (FIG. 7) of the living behaviors when each of the living behavior increases by one unit behavior amount are calculated. The sum of values each obtained by multiplying each of the behavior amount variations by the environment load basic unit per each of the living behaviors is calculated, thereby calculating the environmental load variation (FIG. 8) of each living behavior when the each living behavior increases by one unit behavior amount.

In the measurement phase S22 of measuring a variation in behavior amount upon presenting message information on the basis of the environmental load variation (FIG. 8) calculated in correspondence with each living behavior, a message to reduce the behavior amount is assigned to a living behavior that increases the environmental load upon increasing by one unit behavior amount. A message to increase the behavior amount is assigned to a living behavior that decreases the environmental load upon increasing by one unit behavior amount.

Next, improved behavior amount data representing the behavior amount of each of the living behaviors of the user, which is measured when the message assigned to the living behavior is presented to the user, is stored.

In the information presentation phase S23, the environmental load reduction of each living behavior is calculated by (a) calculating the variation between the unimproved behavior amount of the each living behavior and the improved behavior amount of the each living behavior which is measured when the message assigned to the each living behavior is presented to the user, and (b) multiplying the variation by the environmental load variation of the each living behavior. The message assigned to one of the plurality of living behaviors, which has a largest environmental load reduction, is selected.

According to the above embodiment, the correlation of behavior amount between the living behaviors of a user in a household is calculated. On the basis of this correlation, the variations in environmental loads according to the change in behavior amount of each living behavior are compared. This allows detecting and improving the living behavior with a highest environmental load reduction effect in the living behaviors of the user so that the environmental load generated by the living behaviors at home can efficiently be reduced.

It is also possible to store the technique (especially the function of the external storage unit 2 and arithmetic unit 3 in FIG. 1) of the present invention described in the embodiment in a recording medium such as a magnetic disk (e.g., flexible disk or hard disk), an optical disk (e.g., CD-ROM or DVD), or a semiconductor memory as a program executable by a computer and distribute the recording medium.

What is claimed is:

1. An apparatus for reducing environmental load generated from a plurality of different kinds of living behaviors in everyday life of a user, comprising:

a first memory to store unimproved behavior amounts of the living behaviors;

a second memory to store basic units of the living behaviors, one of the basic units being an environmental load generated per unit behavior amount of corresponding one of the living behaviors;

a first calculation unit configured to calculate, based on the unimproved behavior amounts, behavior amount variations of the living behaviors when each of the living behaviors increases by one unit behavior amount;

a second calculation unit configured to calculate an environmental load variation of a living behavior of the living behaviors when the living behavior increases by one unit behavior amount, by calculating a sum of values each obtained by multiplying one of the behavior amount variations by corresponding one of the basic units, to obtain a plurality of environmental load variations of the living behaviors;

an assigning unit configured to assign messages to the living behaviors based on the environment load variations of the living behaviors, the messages including a first message group and a second message group, (a) each message, included in the first message group, being assigned to corresponding one of the living behaviors which increases the environmental load, and being for reducing the behavior amount of the one of the living behaviors, and (b) each message, included in the second message group, being assigned to corresponding another of the living behaviors which decreases the environmental load, and being for increasing the behavior amount of the another of the living behaviors;

a third memory to store improved behavior amounts of the living behaviors, one of the improved behavior amounts of corresponding one of the living behaviors being measured when one of the messages which is assigned to the one of the living behaviors is presented to the user;

a third calculation unit configured to calculate an environmental load reduction of a living behavior of the living behavior by (a) calculating a variation between one of the unimproved behavior amounts of the living behavior and one of the improved behavior amounts of the living behavior, and (b) multiplying the variation by the environmental load variation of the living behavior, to obtain a plurality of environmental load reductions of the living behaviors; and a selecting unit configured to select one of the messages which is assigned to one of the living behaviors has the largest environmental load reduction.

2. The apparatus according to claim 1, wherein the unimproved behavior amounts are unimproved daily behavior amounts of the living behaviors, and the improved behavior amounts are improved daily behavior amounts of the living behaviors.

3. The apparatus according to claim 1, wherein the third calculation unit calculates the variation between an average of the unimproved daily behavior amounts of the living behavior and an average of the improved daily behavior amounts of the living behavior, and multiplies the variation by the environmental load variation of the living behavior.

4. The apparatus according to claim 1, wherein the environmental load is one of CO2 emission, water consumption, electricity consumption, and gas consumption.

5. A method for reducing environmental load generated from a plurality of different kinds of living behaviors in everyday life of a user, comprising:

storing, in a first memory, unimproved behavior amounts of the living behaviors;

storing, in a second memory, basic units of the living behaviors, one of the basic units being an environmental load generated per unit behavior amount of corresponding one of the living behaviors;

calculating, based on the unimproved behavior amounts, behavior amount variations of the living behaviors when each of the living behaviors increases by one unit behavior amount;

calculating an environmental load variation of a living behavior of the living behaviors when the living behavior increases by one unit behavior amount, by calculating a sum of values each obtained by multiplying one of the behavior amount variations by corresponding one of the basic units, to obtain a plurality of environmental load variations of the living behaviors;

assigning messages to the living behaviors based on the environment load variations of the living behaviors, the messages including a first message group and a second message group, (a) each message, included in the first message group, being assigned to corresponding one of the living behaviors which increases the environmental load, and being for reducing the behavior amount of the one of the living behaviors, and (b) each message, included in the second message group, being assigned to corresponding another of the living behaviors which decreases the environmental load, and being for increasing the behavior amount of the another of the living behaviors;

storing, in a third memory, improved behavior amounts of the living behaviors, one of the improved behavior amounts of corresponding one of the living behaviors being measured when one of the messages which is assigned to the one of the living behaviors is presented to the user;

calculating an environmental load reduction of a living behavior of the living behavior by (a) calculating a variation between one of the unimproved behavior amounts of the living behavior and one of the improved behavior amounts of the living behavior, and (b) multiplying the variation by the environmental load variation of the living behavior, to obtain a plurality of environmental load reductions of the living behaviors; and selecting one of the messages which is assigned to one of the living behaviors has the largest environmental load reduction.

6. The method according to claim 5, wherein the unimproved behavior amounts are unimproved daily behavior amounts of each of the living behaviors of the user, and the improved behavior amounts are improved daily behavior amounts of each of living behaviors of the user.

7. The method according to claim 5, wherein calculating the environmental load reduction of the living behavior calculates the variation between an average of the unimproved daily behavior amounts of the living behavior and an average of the improved daily behavior amounts of the living behavior, and multiplies the variation by the environmental load variation of the living behavior.

8. The method according to claim 5, wherein the environmental load is one of CO2 emission, water consumption, electricity consumption, and gas consumption.

* * * * *